US009231382B2

(12) United States Patent
Katsuraya et al.

(10) Patent No.: US 9,231,382 B2
(45) Date of Patent: Jan. 5, 2016

(54) PLASMA IGNITION DEVICE AND PLASMA IGNITION METHOD

(75) Inventors: Kohei Katsuraya, Aichi (JP); Tatsunori Yamada, Aichi (JP); Katsutoshi Nakayama, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 273 days.

(21) Appl. No.: 13/881,391

(22) PCT Filed: Aug. 18, 2011

(86) PCT No.: PCT/JP2011/004618

§ 371 (c)(1),
(2), (4) Date: Apr. 25, 2013

(87) PCT Pub. No.: WO2012/070172

PCT Pub. Date: May 31, 2012

(65) Prior Publication Data

US 2013/0214689 A1 Aug. 22, 2013

(30) Foreign Application Priority Data

Nov. 25, 2010 (JP) ..... 2010-262025

(51) Int. Cl.

| | |
|---|---|
| ***H01T 13/40*** | (2006.01) |
| ***F02P 9/00*** | (2006.01) |
| ***F02P 3/00*** | (2006.01) |
| *F02P 23/04* | (2006.01) |

(52) U.S. Cl.

CPC . *H01T 13/40* (2013.01); *F02P 3/00* (2013.01); *F02P 9/007* (2013.01); *F02P 23/04* (2013.01); *F02P 23/045* (2013.01)

(58) Field of Classification Search

USPC ..... 315/174, 209 M, 209 T; 123/605, 606, 123/608, 620

See application file for complete search history.

(56) References Cited

U.S. PATENT DOCUMENTS

| | | | | |
|---|---|---|---|---|
| 3,934,566 | A | 1/1976 | Ward | 123/119 |
| 4,138,980 | A | 2/1979 | Ward | 123/119 |
| 4,996,967 | A | 3/1991 | Rosswurm et al. | 123/598 |
| 6,550,463 | B1 * | 4/2003 | Schmolla | 123/606 |
| 6,662,793 | B1 * | 12/2003 | Allen | H01T 13/50 123/143 R |
| 8,342,147 | B2 * | 1/2013 | Nouvel et al. | 123/143 B |
| 2010/0196208 | A1 | 8/2010 | Makita et al. | 422/83 |

(Continued)

FOREIGN PATENT DOCUMENTS

| | | | |
|---|---|---|---|
| JP | 51-77719 | 7/1976 | F02H 27/00 |
| JP | 57-013272 | 1/1982 | F02D 43/00 |

(Continued)

OTHER PUBLICATIONS

International Search Report for International Application No. PCT/JP2011/004618, Sep. 13, 2011.

(Continued)

*Primary Examiner* — An Luu
(74) *Attorney, Agent, or Firm* — Kusner & Jaffe

(57) ABSTRACT

A technique of improving the life of a spark plug which generates spark discharge and AC plasma. A plasma ignition device includes a power control section which reduces AC power P after generation of AC plasma in an AC power supply period Sa during which the AC power P is continuously supplied to a spark plug within a maintainable power range Rp within which the AC plasma can be maintained.

18 Claims, 11 Drawing Sheets

(56) References Cited

U.S. PATENT DOCUMENTS

| | | | | |
|---|---|---|---|---|
| 2011/0139135 | A1 | 6/2011 | Makarov et al. | 123/623 |
| 2011/0202543 | A1 | 8/2011 | Chin et al. | 707/749 |

FOREIGN PATENT DOCUMENTS

| | | | |
|---|---|---|---|
| JP | 59-5791 | 2/1984 | F02P 15/00 |
| JP | 60-98168 | 6/1985 | F02P 3/01 |
| JP | 3-264772 | 11/1991 | F02P 3/01 |
| JP | 2009-36198 | 2/2009 | F02P 23/04 |
| JP | 2009-103038 | 5/2009 | F02P 23/04 |
| JP | 2009-281188 | 12/2009 | F02P 3/01 |
| JP | 2010-37948 | 2/2010 | F02B 1/12 |
| JP | 2010-96109 | 4/2010 | F02P 23/04 |
| JP | 2010-144618 | 7/2010 | F02P 3/01 |
| JP | 2010-249033 | 11/2010 | F02P 23/04 |
| JP | 2011-530039 | 12/2011 | F02P 3/01 |
| WO | WO 2009/147335 | 12/2009 | F02P 9/00 |

OTHER PUBLICATIONS

Notification of Reasons for Refusal (dated Sep. 18, 2012) issued in connection with corresponding Japanese Patent Application No. 2010-262025, with English translation.

* cited by examiner

PLASMA IGNITION DEVICE AND PLASMA IGNITION METHOD

FIELD OF THE INVENTION

The present invention relates to a plasma ignition technique of generating AC plasma between the electrodes of a spark plug (ignition plug) for the purpose of ignition.

BACKGROUND OF THE INVENTION

In a conventional plasma ignition technique, spark discharge is generated between the electrodes of a spark plug by means of DC power, and in this state AC plasma is generated between the electrodes by means of AC power (see, for example, Japanese Patent Application Laid-Open (kokai) No. S51-77719 "Patent Document 1" and Japanese Patent Application Laid-Open (kokai) No. 2009-36198 "Patent Document 2"). Also, there has been proposed a technique of increasing stepwise AC power during generation of AC plasma in order to expand the AC plasma (see, for example, Pamphlet of WO2009/147335 "Patent Document 3").

SUMMARY OF THE INVENTION

Problems to be Solved by the Invention

Generation of AC plasma by means of excessively large AC current raises a problem of accelerating consumption of the electrodes, and excessive restraint of the energy of AC power raises a problem of failure in generation of AC plasma.

In view of the above-described problems, an object of the present invention is to provide a technique of improving the life of a spark plug which generates AC plasma.

Means for Solving the Problems

The present invention has been conceived to solve, at least partially, the above problems and can be embodied in the following modes or application examples.

APPLICATION EXAMPLE 1

A plasma ignition device of application example 1 comprises a spark plug, and an AC power supply which generates AC power for generating AC plasma between electrodes of the spark plug, the plasma ignition device being characterized by further comprising a power control section which reduces the AC power after AC plasma has been generated between the electrodes in an AC power supply period during which the AC power is continuously supplied to the spark plug within a maintainable power range within which the AC plasma can be maintained.

APPLICATION EXAMPLE 2

In a plasma ignition device of application example 1, the power control section may reduce the AC power in the AC power supply period at a timing which is after the AC plasma has been generated between the electrodes and is before elapse of a time corresponding to 75% of the AC power supply period.

APPLICATION EXAMPLE 3

In a plasma ignition device of application example 1 or application example 2, the power control section may reduce the AC power to a power which falls within the maintainable power range and is equal to or less than 80% of the AC power at the time of generation of the AC plasma.

APPLICATION EXAMPLE 4

In a plasma ignition device of any one of application example 1 to application example 3, the power control section may reduce the AC power in the AC power supply period at a timing which is after the AC plasma has been generated between the electrodes and falls within a 1.0 msec period after the start of supply of the AC power.

APPLICATION EXAMPLE 5

In a plasma ignition device of any one of application example 1 to application example 4, the AC power supply period may be 5.0 msec or less.

APPLICATION EXAMPLE 6

In a plasma ignition device of any one of application example 1 to application example 5, the electric energy supplied to the spark plug by the AC power during the AC power supply period of each cycle may be 900 mJ or less.

APPLICATION EXAMPLE 7

A plasma ignition device of any one of application example 1 to application example 6 may comprise a DC power supply which generates DC power for generating spark discharge between the electrodes of the spark plug before generation of the AC plasma.

APPLICATION EXAMPLE 8

In a plasma ignition device of application example 7, the end of the AC power supply period may be after the end of a period during which the DC power is applied to the spark plug.

APPLICATION EXAMPLE 9

In a plasma ignition device of application example 7 or application example 8, the power control section may reduce the AC power within the period during which the DC power is applied to the spark plug.

APPLICATION EXAMPLE 10

A plasma ignition method of application example 10 is adapted to generate AC plasma between electrodes of a spark plug using AC power generated by an AC power supply and is characterized by comprising the step of reducing the AC power after having generated AC plasma between the electrodes in an AC power supply period during which the AC power is continuously supplied to the spark plug within a maintainable power range within which the AC plasma can be maintained.

APPLICATION EXAMPLE 11

In a plasma ignition method of application example 10, the AC power may be reduced in the AC power supply period at a timing which is after the AC plasma has been generated between the electrodes and is before elapse of a time corresponding to 75% of the AC power supply period.

APPLICATION EXAMPLE 12

In a plasma ignition method of application example 10 or application example 11, the AC power may be reduced to a power which falls within the maintainable power range and is equal to or less than 80% of the AC power at the time of generation of the AC plasma.

APPLICATION EXAMPLE 13

In a plasma ignition method of any one of application example 10 to application example 12, the AC power may be reduced in the AC power supply period at a timing which is after the AC plasma has been generated between the electrodes and falls within a 1.0 msec period after the start of supply of the AC power.

APPLICATION EXAMPLE 14

In a plasma ignition method of any one of application example 10 to application example 13, the AC power supply period may be restricted to 5.0 msec or less.

APPLICATION EXAMPLE 15

In a plasma ignition method of any one of application example 10 to application example 14, the electric energy supplied to the spark plug by the AC power during the AC power supply period of each cycle may be restricted to 900 mJ or less.

APPLICATION EXAMPLE 16

In a plasma ignition method of any one of application example 10 to application example 15, before generation of the AC plasma, spark discharge may be generated between the electrodes of the spark plug using DC power generated by a DC power supply.

APPLICATION EXAMPLE 17

In a plasma ignition method of application example 16, the AC power supply period may be ended after the end of a period during which the DC power is applied to the spark plug.

APPLICATION EXAMPLE 18

In a plasma ignition method of application example 16 or application example 17, the AC power may be reduced within the period during which the DC power is applied to the spark plug.

The modes of the present invention are not limited to the plasma ignition device and the plasma ignition method. For example, the present invention can be applied to various modes, such as an internal combustion engine having a plasma ignition device and a program for causing a computer to realize a function of controlling the plasma ignition device. Also, the present invention is not limited to the above-described modes, and can, of course, be implemented in various forms without departing from the scope of the present invention.

Effects of the Invention

According to the plasma ignition device of application example 1, the total energy supplied to the electrodes by AC power so as to generate and maintain AC plasma can be reduced. Therefore, consumption of the electrodes caused by AC plasma can be suppressed. As a result, the life of the spark plug which generates AC plasma can be extended.

According to the plasma ignition device of application example 2, consumption of the electrodes caused by AC plasma can be suppressed further.

According to the plasma ignition device of application example 3, consumption of the electrodes caused by AC plasma can be suppressed further.

According to the plasma ignition device of application example 4, consumption of the electrodes caused by AC plasma can be suppressed further.

According to the plasma ignition device of application example 5, consumption of the electrodes caused by AC plasma can be suppressed further.

According to the plasma ignition device of application example 6, consumption of the electrodes caused by AC plasma can be suppressed further.

According to the plasma ignition device of application example 7, consumption of the electrodes caused by AC plasma can be suppressed in a plasma ignition device configured such that AC plasma is generated between the electrodes between which spark discharge has been generated.

According to the plasma ignition device of application example 8, the performance of ignition by AC plasma can be improved.

According to the plasma ignition device of application example 9, consumption of the electrodes caused by AC plasma can be suppressed further.

According to the plasma ignition method of application example 10, the total energy supplied to the electrodes by AC power so as to generate and maintain AC plasma can be reduced. Therefore, consumption of the electrodes caused by AC plasma can be suppressed. As a result, the life of the spark plug which generates AC plasma can be extended.

According to the plasma ignition method of application example 11, consumption of the electrodes caused by AC plasma can be suppressed further.

According to the plasma ignition method of application example 12, consumption of the electrodes caused by AC plasma can be suppressed further.

According to the plasma ignition method of application example 13, consumption of the electrodes caused by AC plasma can be suppressed further.

According to the plasma ignition method of application example 14, consumption of the electrodes caused by AC plasma can be suppressed further.

According to the plasma ignition method of application example 15, consumption of the electrodes caused by AC plasma can be suppressed further.

According to the plasma ignition method of application example 16, consumption of the electrodes caused by AC plasma can be suppressed in a method in which AC plasma is generated between the electrodes between which spark discharge has been generated.

According to the plasma ignition method of application example 17, the performance of ignition by AC plasma can be improved.

According to the plasma ignition method of application example 18, consumption of the electrodes caused by AC plasma can be suppressed further.

DETAILED DESCRIPTION OF THE INVENTION

In order to clarify the configuration and action of the present invention having been described above, a plasma ignition device to which the present invention is applied will now be described.

A. Embodiment

A-1. Configuration of Plasma Ignition Device

Figure 1:
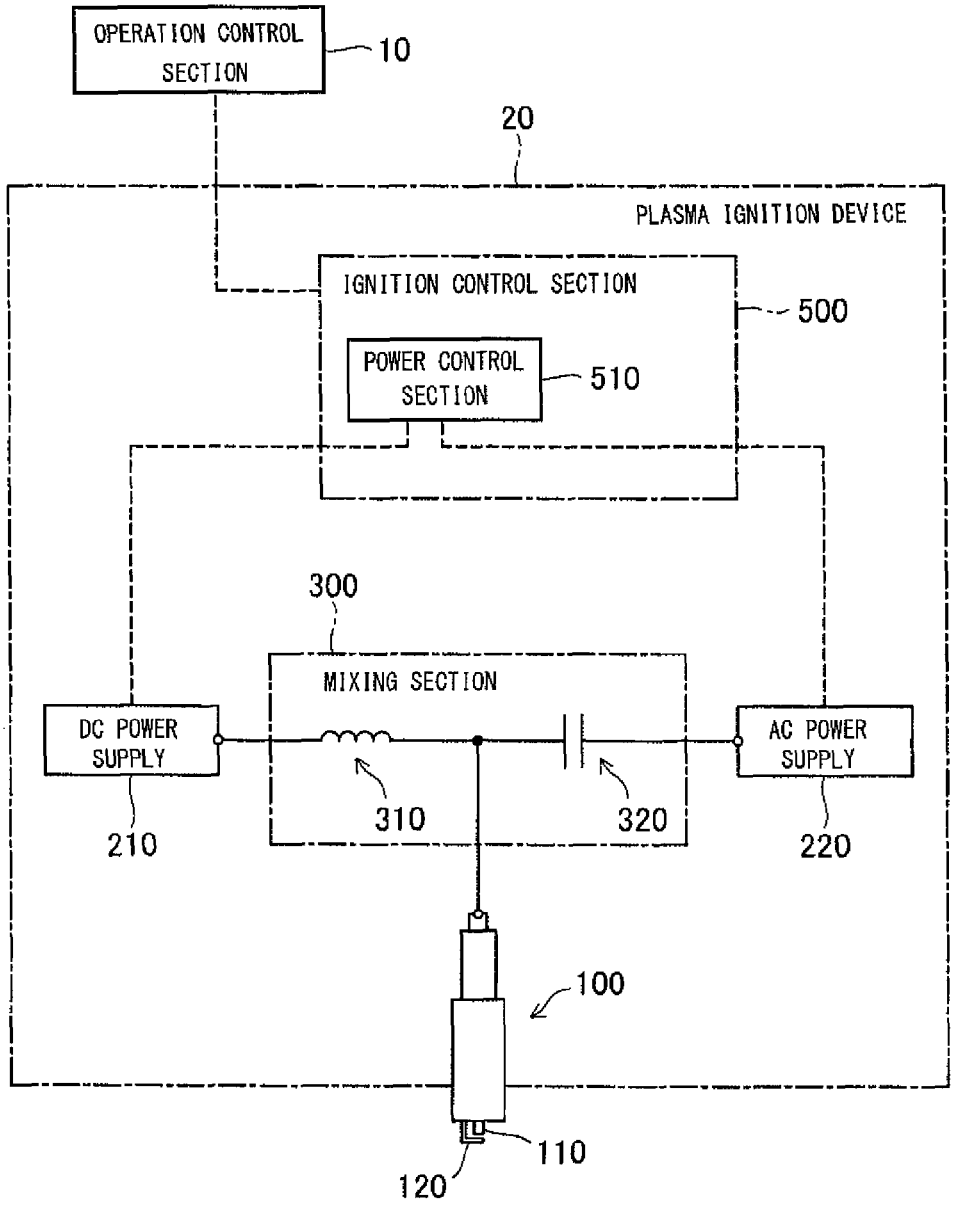
FIG. 1 is an explanatory view showing a plasma ignition device.

FIG. 1 is an explanatory view showing a plasma ignition device 20. The plasma ignition device 20 effects ignition by generating AC plasma between a center electrode 110 and a ground electrode 120 of a spark plug 100. In the present embodiment, the plasma ignition device 20 is a device for igniting fuel of an internal combustion engine (not shown).

Specifically, after generating spark discharge through application of DC power to the center electrode 110 of the spark plug 100, the plasma ignition device 20 applies AC power to the center electrode 110 of the spark plug 100 to thereby generate AC plasma. Once AC plasma is generated between the electrodes of the spark plug 100, in order to suppress consumption of the electrodes caused by the AC plasma, the plasma ignition device 20 reduces the AC power applied to center electrode 110, while maintaining the AC plasma between the electrodes of the spark plug 100. The details of reduction in AC power in the plasma ignition device 20 will later be described.

The plasma ignition device 20 includes a DC power supply 210, a AC power supply 220, a mixing section 300, and an ignition control section 500, in addition to the spark plug 100. In the present embodiment, the plasma ignition device 20 is electrically connected to an operation control section 10 for controlling operation of the internal combustion engine, and realizes ignition control suitable for the operation state of the internal combustion engine on the basis of a control signal output from the operation control section 10.

The DC power supply 210 of the plasma ignition device 20 generates DC power for generating spark discharge between the electrodes of the spark plug 100. In the present embodiment, the DC power produced by the DC power supply 210 is high voltage pluses of several tens of thousands volts.

The AC power supply 220 of the plasma ignition device 20 produces AC power for generating AC plasma between the electrodes of the spark plug 100. In the present embodiment, preferably, the frequency f of the AC power produced by the AC power supply 220 satisfies a relation "50 kHz (kilohertz) ≤f≤100 MHz (megahertz)" in order to generate AC plasma.

The mixing section 300 of the plasma ignition device 20 combines together the DC power produced by the DC power supply 210 and the AC power produced by the AC power supply 220, and transmits the resultant power to the spark plug 100. The mixing section 300 includes an inductor (coil) 310 and a capacitor 320. The inductor 310 of the mixing section 300 electrically connects the DC power supply 210 to the center electrode 110 of the spark plug 100 and the AC power supply 220, and restrains flow of the AC power generated by the AC power supply 220 toward the DC power supply 210. In the case where the DC power supply 210 includes an inductor (e.g., in the case where an ignition coil is used for the DC power supply), the inductor 310 of the mixing section 300 is not necessary. The capacitor 320 of the mixing section 300 electrically connects the AC power supply 220 to the center electrode 110 of the spark plug 100 and the DC power supply 210, and restrains flow of the DC power generated by the DC power supply 210 toward the AC power supply 220.

The center electrode 110 of the spark plug 100 is electrically connected to the DC power supply 210 and the AC power supply 220 via the mixing section 300, and the ground electrode 120 of the spark plug 100 is electrically grounded. In the AC power transmission path from the AC power supply 220 to the spark plug 100, a reflection loss (return loss) of AC power is produced at an impedance discontinuity point. Therefore, the electric power input to the center electrode 110 as a result of application of the AC power to the center electrode 110 of the spark plug 100 is equal to an electric power obtained by subtracting the reflection loss from the AC power applied from the AC power supply 220. In the present embodiment, the reflection loss produced between the AC power supply 220 and the center electrode 110 is 10% or less.

The ignition control section 500 of the plasma ignition device 20 performs ignition control suitable for the operation state of the internal combustion engine on the basis of the control signal output from the operation control section 10. The ignition control section 500 includes a power control section 510 which controls the operations of the DC power supply 210 and the AC power supply 220. In the present embodiment, the function of the power control section 510 of the ignition control section 500 is realized by a CPU (Central Processing Unit) of the ignition control section 500 which operates on the basis of a program. In other embodiments, the function of at least a portion of the ignition control section 500 may be realized by the physical circuit configuration of the ignition control section 500.

The power control section 510 of the ignition control section 500 instructs the DC power supply 210 to generate DC power and instructs the AC power supply 220 to generate AC power in such a manner that AC plasma is generated after generation of spark discharge between the electrodes of the spark plug 100. In particular, after AC plasma is generated between the electrodes of the spark plug 100 in an AC power supply period during which AC power is continuously supplied to the spark plug 100 within a maintainable power range within which the AC plasma can be maintained, the power control section 510 reduces the AC power supplied to the spark plug 100 by controlling the AC power generated by the AC power supply 220.

Figure 2:
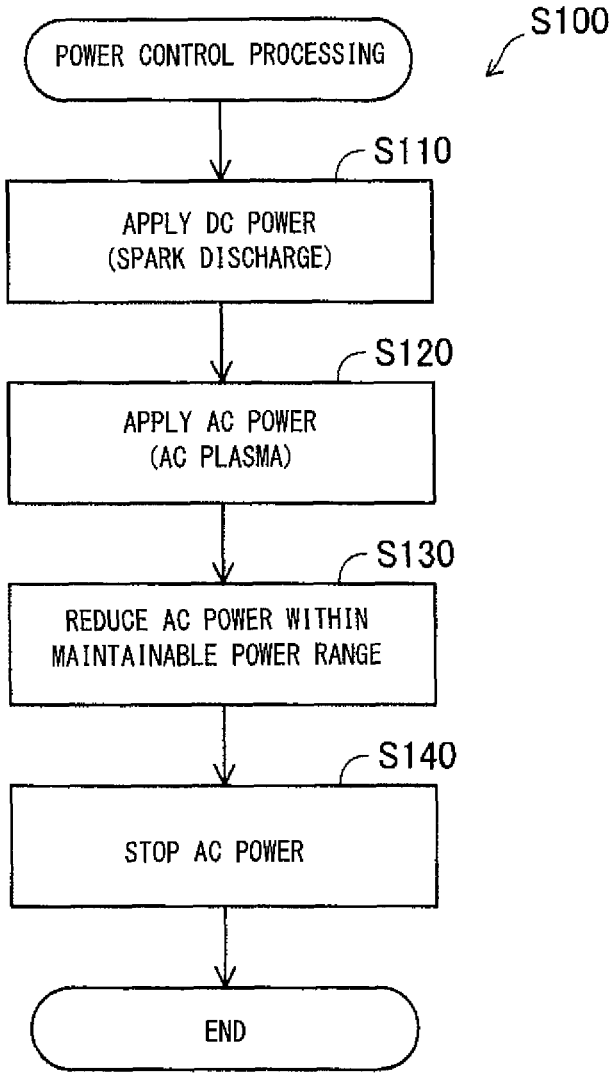
FIG. 2 is a flowchart showing power control processing executed by a power control section.

FIG. 2 is a flowchart showing power control processing (step S100) executed by the power control section 510. The power control processing (step S100) controls the operations of the DC power supply 210 and the AC power supply 220. In the present embodiment, the power control section 510 executes the power control processing (step S100) every time ignition is performed once.

Upon start of the power control processing (step S100), the power control section 510 starts the application of DC power to the center electrode 110 of the spark plug 100 by instructing the DC power supply 210 to generate DC power (step S110). As a result, spark discharge is generated between the electrodes of the spark plug 100.

After having generated the spark discharge (step S110), the power control section 510 starts the application of AC power to the center electrode 110 of the spark plug 100 by instructing the AC power supply 220 to generate AC power, while continuing the application of DC power by the DC power supply 210 (step S120). As a result, AC plasma is generated between the electrodes of the spark plug 100.

After having generated the AC plasma (step S120), the power control section 510 reduces the AC power applied to the center electrode 110 of the spark plug 100 by instructing the AC power supply 220 to reduce the AC power (step S130). As a result, the AC plasma between the electrodes of the spark plug 100 is maintained through application of the reduced AC power as compared with that at the start of application of the AC power.

After having reduced the AC power (step S130), the power control section 510 stops the application of the AC power to the center electrode 110 of the spark plug 100 by instructing the AC power supply 220 to stop generation of AC power (step S140). As a result, the AC plasma disappears from the space between the electrodes of the spark plug 100. After having stopped the AC power (step S140), the power control section 510 ends the power control processing (step S100).

In the present embodiment, the power control section 510 stops the generation of DC power by the DC power supply 210 at a timing between the reduction of AC power (step S130) and the stoppage of AC power (step S140); however, in other embodiments, the generation of DC power may be stopped before the reduction of AC power (step S130) or after the stoppage of AC power (step S140).

Figure 3:
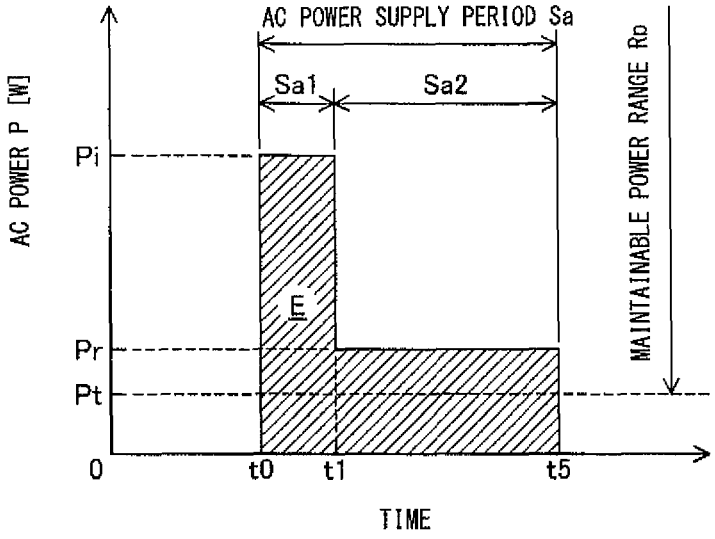
FIG. 3 is an explanatory graph showing a time-course change in AC power during a period during which the power control processing is performed once.

FIG. 3 is an explanatory graph showing a change with time (hereinafter referred to as a "time-course change") in the AC power P during a period during which the power control processing (step S100) is performed once. The AC power P is a work performed per unit time by the AC current supplied from the AC power supply 220 to the spark plug 100. In FIG. 3, a time-course change in AC power P is shown by a graph whose horizontal axis represents time and whose vertical axis represents electric power. The product of AC power P and time, which is hatched in FIG. 3, represents AC electric energy E which is a work performed by the AC current supplied in each period during which the power control processing (step S100) is performed once.

As shown in FIG. 3, the AC power P is reduced from a first power Pi to a second power Pr in the middle (timing t1) of an AC power supply period Sa (timings t0 to t5) during which the AC power P is supplied from the AC power supply 220 to the spark plug 100. The first power Pi and the second power Pr fall within a maintainable power range Rp; i.e., are equal to or greater than the minimum power Pt required to maintain the AC plasma generated between the electrodes of the spark plug 100.

At the beginning of the AC power supply period Sa (timing t0), the AC power P is set to the first power Pi. The AC power P is maintained at the fixed first power Pi during a first supply period Sa1 (timings t0 to t1), which is the first half of the AC power supply period Sa. After the first supply period Sa1 (timings t0 to t1), the AC power P is reduced from the first power Pi to the second power Pr, and is maintained at the fixed second power Pr during a second supply period Sa2 (timings t1 to t5) including the end of the AC power supply period Sa (timing t5).

A-2. Evaluation on the Timing at which the AC Power P is Reduced

Figure 4:
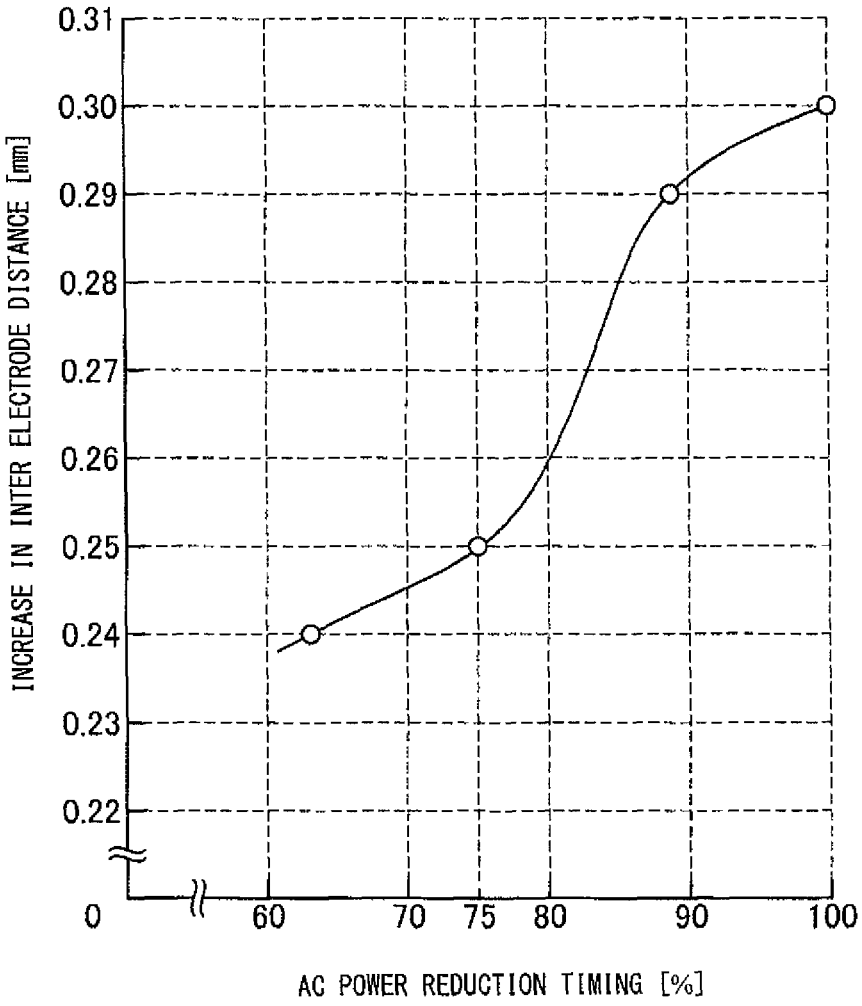
FIG. 4 is an explanatory graph showing the results of an evaluation test for investigating the relation between AC power reduction timing and electrode consumption.

FIG. 4 is an explanatory graph showing the results of an evaluation test performed so as to investigate the relation between the timing of reduction of the AC power P and the consumption of the electrodes. In FIG. 4, the relation between the timing of reduction of the AC power P and the consumption of the electrodes is shown by a graph whose horizontal axis represents the timing of reduction of the AC power P and whose vertical axis represents an increase in the interelectrode distance of the spark plug 100. The timing of reduction of the AC power P shown in FIG. 4 is a relative lapse time (timing t1 in FIG. 3) during the AC power supply period Sa. The relative lapse time is 0% at the beginning of the AC power supply period Sa (timing t0 in FIG. 3), and becomes 100% at the end of the AC power supply period Sa (timing t5 in FIG. 3).

In the evaluation test the results of which are shown in FIG. 4, the plasma ignition device 20 was caused to execute the power control processing (step S100) for each of spark plugs 100 (samples), while the timing of reduction of the AC power P was changed among the samples. For each of the samples, an increase in the interelectrode distance between the center electrode 110 and the ground electrode 120 of the spark plug 100 was measured. Specifically, in a state in which the center electrode 110 and the ground electrode 120 of the spark plug 100 were exposed to an atmosphere of 0.4 MPa (mega Pascal), the power control processing (step S100) was continuously executed at a frequency of 15 Hz (Hertz) for 40 hours. In the evaluation test the results of which are shown in FIG. 4, the power input from the AC power supply 220 to the spark plug 100 and the reflected power were measured using a directional coupler. The measurement revealed that the reflection loss from the AC power supply 220 to the center electrode 110 was 10% or less.

The spark plug 100 used for the evaluation test the results of which are shown in FIG. 4 had a center electrode 110 made of a nickel alloy and having a diameter of 2.5 mm (millimeter), and the interelectrode distance between the center electrode 110 and the ground electrode 120 was 0.8 mm before performance of the evaluation test. In the evaluation test the results of which are shown in FIG. 4, DC power was applied to the spark plug 100 for 2.5 ms (millisecond) by the DC power supply 210 such that the total supplied energy became 60 mJ (millijoule), and AC power P was supplied simultaneously with the application of the DC power.

In the evaluation test the results of which are shown in FIG. 4, for the AC power P supplied from the AC power supply 220 to the spark plug 100, the AC power supply period Sa was set to 4.0 ms, the first power Pi during the first supply period Sa1 was set to 250 W (watt), and the second power Pr during the second supply period Sa2 was set to 200 W. The timing of reduction of the AC power P was set to 100% (the AC power P was not reduced), 88% (after elapse of 3.5 ms from the beginning of the AC power supply period Sa), 75% (after elapse of 3.0 ms from the beginning of the AC power supply period Sa), or 63% (after elapse of 2.5 ms from the beginning of the AC power supply period Sa).

As shown in FIG. 4, the increase in the interelectrode distance, which was 0.30 mm in the case where the timing of reduction of the AC power P was 100%, decreased to 0.29 mm when the timing of reduction of the AC power P was 88%, decreased to 0.25 mm when the timing of reduction of the AC power P was 75%, and decreased to 0.24 mm when the timing of reduction of the AC power P was 63%. Namely, the increase in the interelectrode distance decreased as the timing of reduction of the AC power P was advanced. In particular, when the timing of reduction of the AC power P was advanced from 88% to 75%, the increase in the interelectrode distance decreased considerably.

According to the results of the evaluation test shown in FIG. 4, in order to suppress consumption of the electrodes, preferably, the reduction of the AC power P is performed at a timing which is after the generation of AC plasma between the electrodes of the spark plug 100 and before elapse of a time approximately corresponding to 75% of the AC power supply period Sa, more preferably, before elapse of a time approximately corresponding to 63% of the AC power supply period Sa.

A-3. Evaluation on the Reduction Ratio of the AC Power P

Figure 5:
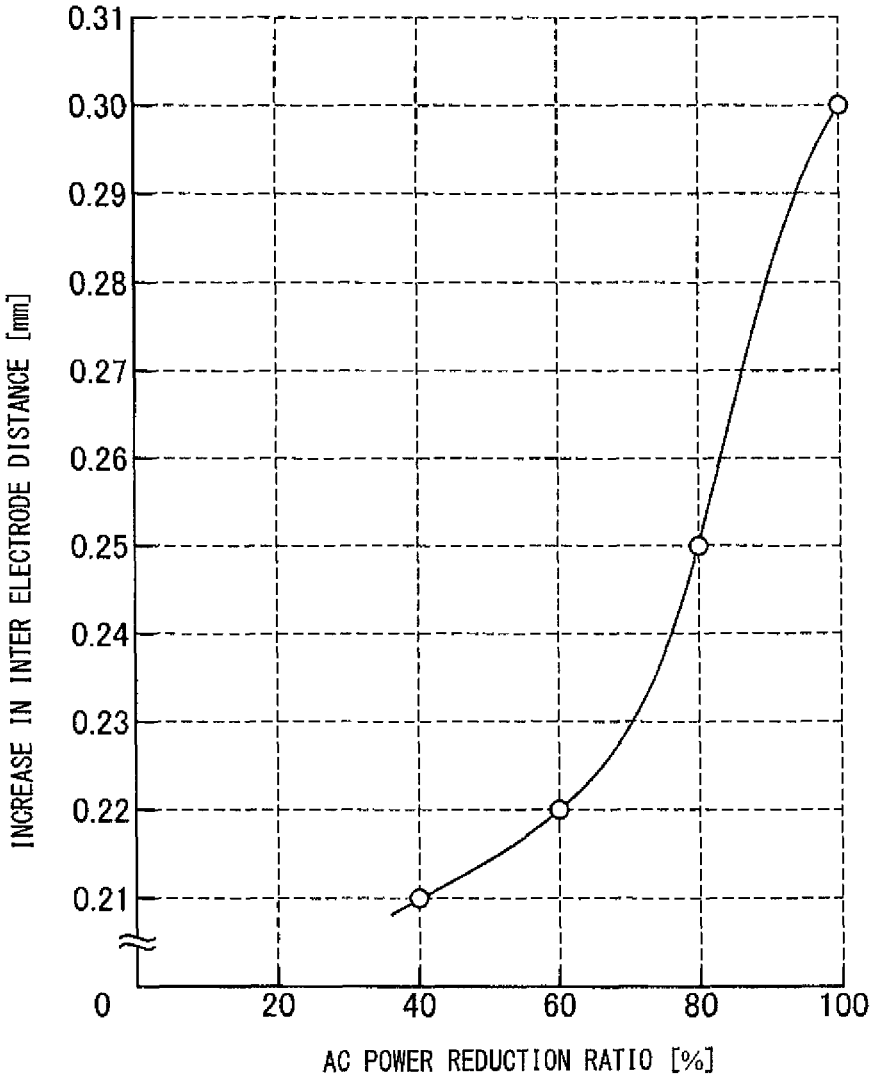
FIG. 5 is an explanatory graph showing the results of an evaluation test for investigating the relation between AC power reduction ratio and electrode consumption.

FIG. 5 is an explanatory graph showing the results of an evaluation test performed so as to investigate the relation between the reduction ratio of the AC power P and the consumption of the electrodes. In FIG. 5, the relation between the reduction ratio of the AC power P and the consumption of the electrodes is shown by a graph whose horizontal axis represents the reduction ratio of the AC power P and whose vertical axis represents an increase in the interelectrode distance of the spark plug 100. The reduction ratio of the AC power P shown in FIG. 5 is the ratio of the second power Pr to the first power Pi. In the case where the AC power P is not reduced (Pr=Pi), the reduction ratio is "100%." In the case where the supply of the AC power P is stopped (Pr=0), the reduction ratio is "0%."

In the evaluation test the results of which are shown in FIG. 5, the plasma ignition device 20 was caused to execute the power control processing (step S100) for each of spark plugs 100 (samples), while the reduction ratio of the AC power P was changed among the samples. For each of the samples, an increase in the interelectrode distance between the center electrode 110 and the ground electrode 120 of the spark plug 100 was measured. Specifically, in a state in which the center electrode 110 and the ground electrode 120 of the spark plug 100 were exposed to an atmosphere of 0.4 MPa, the power control processing (step S100) was continuously executed at a frequency of 15 Hz for 40 hours. In the evaluation test the results of which are shown in FIG. 5, the power input from the AC power supply 220 to the spark plug 100 and the reflected power were measured using a directional coupler. The measurement revealed that the reflection loss from the AC power supply 220 to the center electrode 110 was 10% or less.

The spark plug 100 used in the evaluation test the results of which are shown in FIG. 5 is identical with that used in the evaluation test the results of which are shown in FIG. 4. In the evaluation test the results of which are shown in FIG. 5, DC power was applied to the spark plug 100 for 2.5 ms by the DC power supply 210 such that the total supplied energy became 60 mJ, and AC power P was supplied simultaneously with the application of the DC power.

In the evaluation test the results of which are shown in FIG. 5, for the AC power P supplied from the AC power supply 220 to the spark plug 100, the AC power supply period Sa was set to 4.0 ms, the first power Pi during the first supply period Sa1 was set to 250 W, and the timing of reduction of the AC power P was set to 75% (after 3.0 ms from the beginning of the AC power supply period Sa). The second power Pr during the second supply period Sa2 was set to "250 W" (no reduction of the AC power P), "200 W," "150 W," or "100 W" to thereby change the reduction ratio of the AC power P among "100%," "80%," "60%," and "40%."

As shown in FIG. 5, the increase in the interelectrode distance decreased as the reduction ratio of the AC power P decreased. Specifically, the increase in the interelectrode distance, which was 0.30 mm in the case where the reduction ratio of the AC power P was 100%, decreased to 0.25 mm when the reduction ratio of the AC power P was 80%, decreased to 0.22 mm when the reduction ratio of the AC power P was 60%, and decreased to 0.21 mm when the reduction ratio of the AC power P was 40%. Namely, the smaller the second power Pr (the reduced AC power), the greater the degree to which the increase in the interelectrode distance decreased. Notably, in order to maintain the AC plasma even after the reduction of the AC power P, the second power Pr must be set within the maintainable range Rp; i.e., must be equal to or greater than the power Pt.

According to the results of the evaluation test shown in FIG. 5, in order to suppress consumption of the electrodes, preferably, the AC power P is reduced to a power which falls within the maintainable power range Rp and is equal to or less than 80% of the power at the time of generation of AC plasma, more preferably, to a power equal to or less than 60% of the power at the time of generation of AC plasma, most preferably, to a power equal to or less than 40% of the power at the time of generation of AC plasma.

Figure 6:
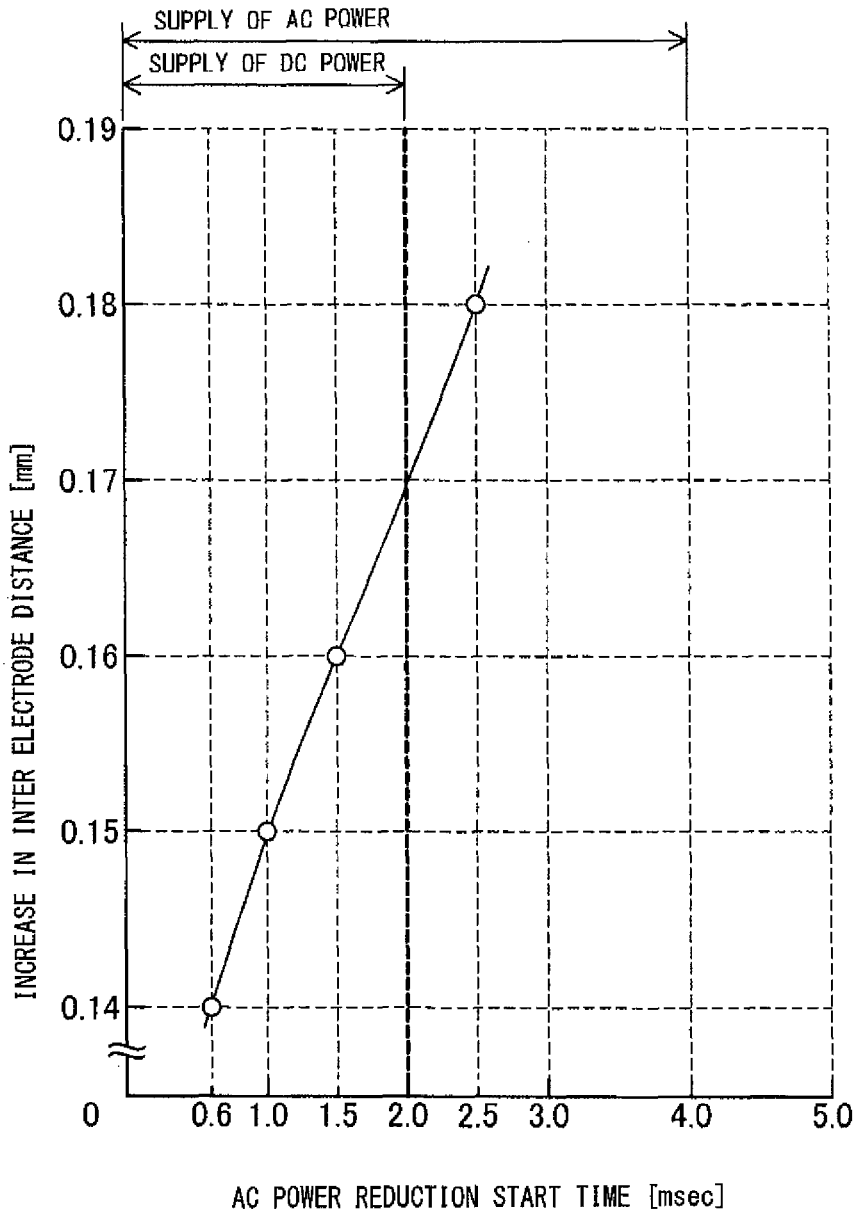
FIG. 6 is an explanatory graph showing the results of an evaluation test for investigating the relation between AC power reduction start time and electrode consumption.

A-4. Evaluation on the Relation Between the Reduction Start Time of the AC Power P and the Consumption of the Electrodes FIG. 6 is an explanatory graph showing the results of an evaluation test performed so as to investigate the relation between the reduction start time of the AC power P and the consumption of the electrodes. In FIG. 6, the relation between the reduction start time of the AC power P and the consumption of the electrodes is shown by a graph whose horizontal axis represents the reduction start time of the AC power P and whose vertical axis represents an increase in the interelectrode distance of the spark plug 100. The reduction start time of the AC power P shown in FIG. 6 is the first supply period Sa1 between the start of supply of the AC power P (timing t0 in FIG. 3) and the start of reduction of the AC power P (timing t1 in FIG. 3).

In the evaluation test the results of which are shown in FIG. 6, the plasma ignition device 20 was caused to execute the power control processing (step S100) for each of spark plugs 100 (samples), while the reduction start time of the AC power P was changed among the samples. For each of the samples, an increase in the interelectrode distance between the center electrode 110 and the ground electrode 120 of the spark plug 100 was measured. Specifically, in a state in which the center electrode 110 and the ground electrode 120 of the spark plug 100 were exposed to an atmosphere of 0.4 MPa, the power control processing (step S100) was continuously executed at a frequency of 15 Hz for 40 hours. In the evaluation test the results of which are shown in FIG. 6, the power input from the AC power supply 220 to the spark plug 100 and the reflected power were measured using a directional coupler. The measurement revealed that the reflection loss from the AC power supply 220 to the center electrode 110 was 10% or less.

The spark plug 100 used in the evaluation test the results of which are shown in FIG. 6 is identical with that used in the evaluation test the results of which are shown in FIG. 4. In the evaluation test the results of which are shown in FIG. 6, DC power was applied to the spark plug 100 for 2.0 ms by the DC power supply 210 such that the total supplied energy became 50 mJ, and AC power P was supplied simultaneously with the application of the DC power.

In the evaluation test the results of which are shown in FIG. 6, for the AC power P supplied from the AC power supply 220 to the spark plug 100, the AC power supply period Sa was set to 4.0 ms, and the first power Pi during the first supply period Sa1 was set to 250 W. Further, the second power Pr was set such that the AC electric energy E became 700 mJ in all samples of the evaluation test which were different in the reduction start time of the AC power P. Specifically, in the case where the reduction start time of the AC power P was "2.5 ms," the second power Pr was set to "50 W." In the case where the reduction start time of the AC power P was "1.5 ms," the second power Pr was set to "130 W." In the case where the reduction start time of the AC power P was "1.0 ms," the second power Pr was set to "150 W." In the case where the reduction start time of the AC power P was "0.6 ms," the second power Pr was set to "160 W."

As shown in FIG. 6, in the case where the reduction start time of the AC power P was 2.5 ms, which was later than the end of the 2.0 ms period (the period during which the DC power was applied), the increase in the interelectrode distance was 0.18 mm. In the case where the reduction start time of the AC power P was 1.5 ms, which was earlier than the end of the period during which the DC power was applied, the increase in the interelectrode distance decreased to 0.16 mm. In the case where the reduction start time of the AC power P was 1.0 ms, the increase in the interelectrode distance decreased more to 0.15 mm. In the case where the reduction start time of the AC power P was 0.6 ms, the increase in the interelectrode distance decreased further to 0.14 mm.

According to the results of the evaluation test shown in FIG. 6, in order to suppress consumption of the electrodes, preferably, the AC power P is reduced within a period during which DC power from the DC power supply 210 is applied to the spark plug 100. Moreover, preferably, the reduction of the AC power P is performed after the start of generation of AC plasma between the electrodes of the spark plug 100 and within a 1.0 ms period after the start of supply of the AC power P (timing t0), more preferably, within a 0.6 ms period after the start of supply of the AC power P.

A-5. Evaluation on the AC Power Supply Period Sa

Figure 7:
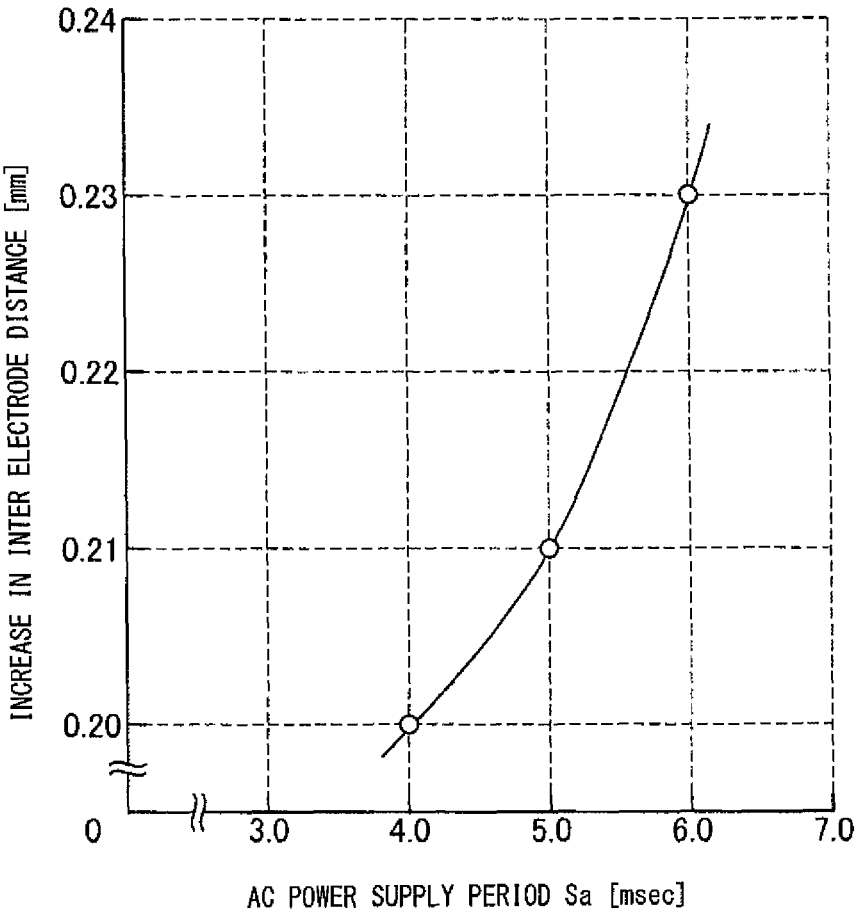
FIG. 7 is an explanatory graph showing the results of an evaluation test for investigating the relation between AC power supply period and electrode consumption.

FIG. 7 is an explanatory graph showing the results of an evaluation test performed so as to investigate the relation between the AC power supply period Sa and the consumption of the electrodes. In FIG. 7, the relation between the AC power supply period Sa and the consumption of the electrodes is shown by a graph whose horizontal axis represents the AC power supply period Sa and whose vertical axis represents an increase in the interelectrode distance of the spark plug 100.

In the evaluation test the results of which are shown in FIG. 7, the plasma ignition device 20 was caused to execute the power control processing (step S100) for each of spark plugs 100 (samples), while the AC power supply period Sa was changed among the samples. For each of the samples, an increase in the interelectrode distance between the center electrode 110 and the ground electrode 120 of the spark plug 100 was measured. Specifically, in a state in which the center electrode 110 and the ground electrode 120 of the spark plug 100 were exposed to an atmosphere of 0.4 MPa, the power control processing (step S100) was continuously executed at a frequency of 15 Hz for 40 hours. In the evaluation test the results of which are shown in FIG. 7, the power input from the AC power supply 220 to the spark plug 100 and the reflected power were measured using a directional coupler. The measurement revealed that the reflection loss from the AC power supply 220 to the center electrode 110 was 10% or less.

The spark plug 100 used in the evaluation test the results of which are shown in FIG. 7 is identical with that used in the evaluation test the results of which are shown in FIG. 4. In the evaluation test the results of which are shown in FIG. 7, DC power was applied to the spark plug 100 for 2.5 ms by the DC power supply 210 such that the total supplied energy became 60 mJ, and AC power P was supplied simultaneously with the application of the DC power.

In the evaluation test the results of which are shown in FIG. 7, for the AC power P supplied from the AC power supply 220 to the spark plug 100, the first supply period Sa1 was set to 2.0 ms, and the first power Pi during the first supply period Sa1 was set to 250 W. Further, the second power Pr was set such that the AC electric energy E became 800 mJ in the all samples of the evaluation test which were different in the AC power supply period Sa. Specifically, in the case where the AC power supply period Sa was "4.0 ms," the second power Pr was set to "150 W." In the case where the AC power supply period Sa was "5.0 ms," the second power Pr was set to "100 W." In the case where the AC power supply period Sa was "6.0 ms," the second power Pr was set to "75 W."

As shown in FIG. 7, the increase in the interelectrode distance, which was 0.23 mm in the case where the AC power supply period Sa was 6.0 ms, decreased to 0.21 mm when the AC power supply period Sa was 5.0 ms, and decreased to 0.20 mm when the AC power supply period Sa was 4.0 ms. In particular, when the AC power supply period Sa became shorter from 6.0 ms to 5.0 ms, the increase in the interelectrode distance decreased considerably.

According to the results of the evaluation test shown in FIG. 7, in order to suppress consumption of the electrodes, preferably, the AC power supply period Sa is 5.0 ms or less, more preferably, 4.0 ms or less.

A-6. Evaluation on the AC Electric Energy E

Figure 8:
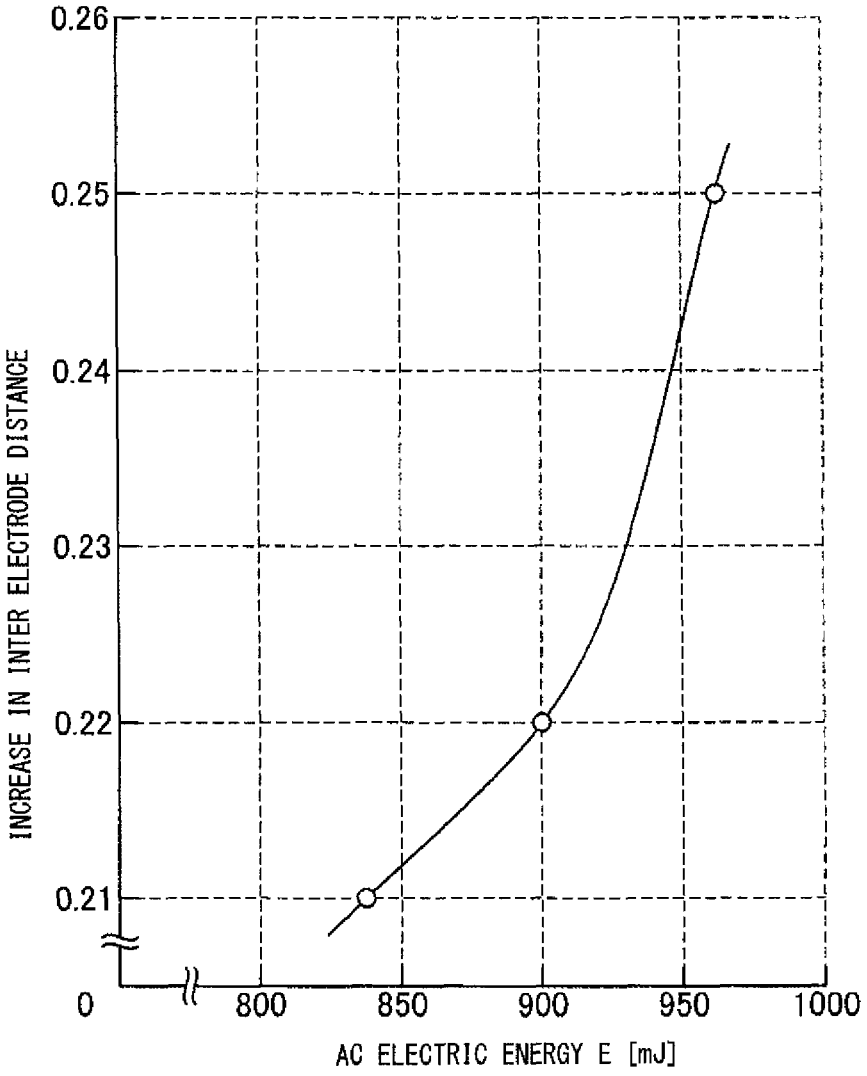
FIG. 8 is an explanatory graph showing the results of an evaluation test for investigating the relation between AC electric energy and electrode consumption.

FIG. 8 is an explanatory graph showing the results of an evaluation test performed so as to investigate the relation between the AC electric energy E and the consumption of the electrodes. In FIG. 8, the relation between the AC electric energy E and the consumption of the electrodes is shown by a graph whose horizontal axis represents the AC electric energy E and whose vertical axis represents an increase in the interelectrode distance of the spark plug 100.

In the evaluation test the results of which are shown in FIG. 8, the plasma ignition device 20 was caused to execute the power control processing (step S100) for each of spark plugs 100 (samples), while the AC electric energy E was changed among the samples. For each of the samples, an increase in the interelectrode distance between the center electrode 110 and the ground electrode 120 of the spark plug 100 was measured. Specifically, in a state in which the center electrode 110 and the ground electrode 120 of the spark plug 100 were exposed to an atmosphere of 0.4 MPa, the power control processing (step S100) was continuously executed at a frequency of 15 Hz for 40 hours. In the evaluation test the results of which are shown in FIG. 8, the power input from the AC power supply 220 to the spark plug 100 and the reflected power were measured using a directional coupler. The measurement revealed that the reflection loss from the AC power supply 220 to the center electrode 110 was 10% or less.

The spark plug 100 used in the evaluation test the results of which are shown in FIG. 8 is identical with that used in the evaluation test the results of which are shown in FIG. 4. In the evaluation test the results of which are shown in FIG. 8, DC power was applied to the spark plug 100 for 2.5 ms by the DC power supply 210 such that the total supplied energy became 60 mJ, and AC power P was supplied simultaneously with the application of the DC power.

In the evaluation test the results of which are shown in FIG. 8, for the AC power P supplied from the AC power supply 220 to the spark plug 100, the AC power supply period Sa was set to 5.0 ms, the first supply period Sa1 was set to 2.0 ms, and the first power Pi during the first supply period Sa1 was set to 300 W. Further, the AC electric energy E was changed among the samples of the evaluation test by changing the second power Pr during the second supply period Sa2. Specifically, the AC electric energy E was set to "840 mJ" by setting the second power Pr to "80 W," was set to "900 mJ" by setting the second power Pr to "100 W," or was set to "960 ml" by setting the second power Pr to "120 W."

As shown in FIG. 8, the increase in the interelectrode distance, which was 0.25 mm in the case where the AC electric energy E was 960 mJ, decreased to 0.22 mm when the AC electric energy E was 900 mJ, and decreased to 0.21 mm when the AC electric energy E was 840 mJ. In particular, when the AC electric energy E decreased from 960 mJ to 900 mJ, the increase in the interelectrode distance decreased considerably.

According to the results of the evaluation test shown in FIG. 8, in order to suppress consumption of the electrodes, preferably, the AC electric energy E is 900 mJ or less, more preferably, 840 mJ or less.

A-7. Evaluation on the Timing of Supply of the AC Power P

Figure 9:
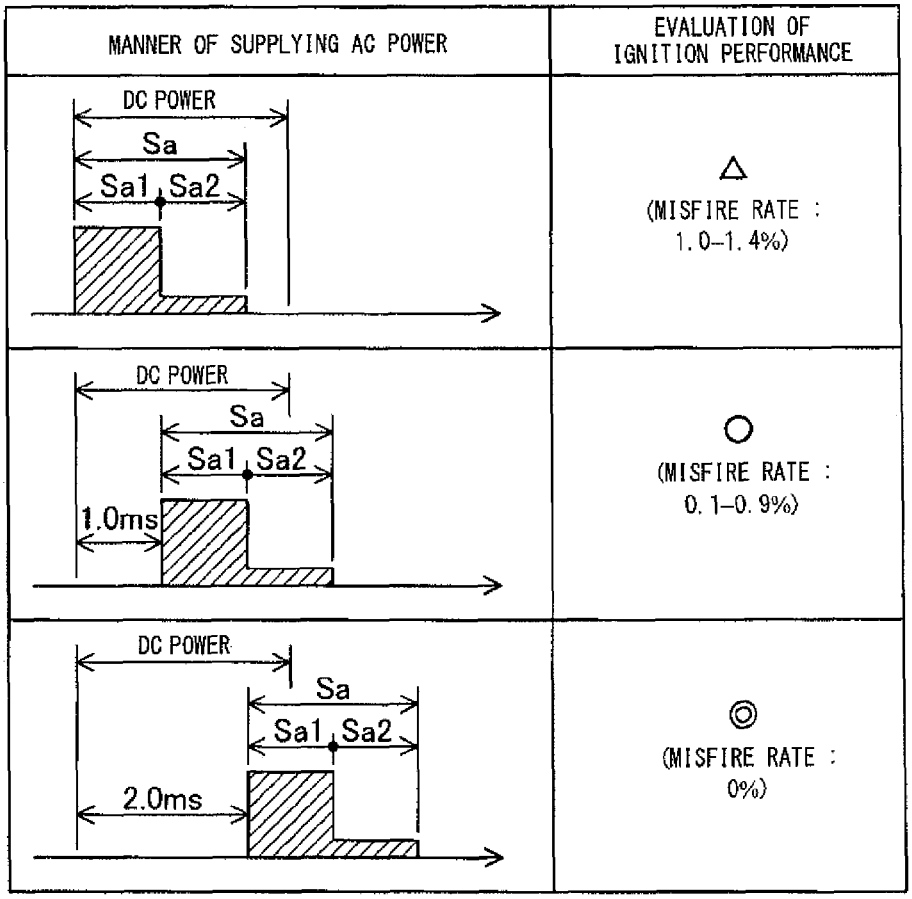
FIG. 9 is an explanatory table showing the results of an evaluation test for investigating the relation between AC power supply timing and ignition performance.

FIG. 9 is an explanatory table showing the results of an evaluation test performed so as to investigate the relation between the timing of supply of the AC power P and ignition performance. FIG. 9 shows different manners of supplying the AC power P and the result of evaluation of ignition performance for each manner of supplying the AC power P. The evaluation of ignition performance of FIG. 9 is such that the lower the rate of misfire, the higher the performance.

In the evaluation test the results of which are shown in FIG. 9, the plasma ignition device 20 was caused to execute the power control processing (step S100) for each of spark plugs 100 (samples), while the timing of supply of the AC power P was changed among the samples. For each of the samples, an increase in the interelectrode distance between the center electrode 110 and the ground electrode 120 of the spark plug 100 was measured. Specifically, a DOHC straight-four-cylinder engine having a displacement of 2000 cc, to which the spark plug 100 was attached, was operated with the air-fuel ratio A/F set to 23 and the rotational speed set to 1600 rpm, and its misfire rate was measured. In the evaluation test the results of which are shown in FIG. 9, the power input from the AC power supply 220 to the spark plug 100 and the reflected power were measured using a directional coupler. The measurement revealed that the reflection loss from the AC power supply 220 to the center electrode 110 was 10% or less.

The spark plug 100 used in the evaluation test the results of which are shown in FIG. 9 is identical with that used in the evaluation test the results of which are shown in FIG. 4. In the evaluation test the results of which are shown in FIG. 9, DC power was applied to the spark plug 100 for 2.5 ms by the DC power supply 210 such that the total supplied energy became 60 mJ.

In the evaluation test the results of which are shown in FIG. 9, for the AC power P supplied from the AC power supply 220 to the spark plug 100, the AC power supply period Sa was set to 2.0 ms, the first supply period Sa1 was set to 1.0 ms, the first power Pi was set to 250 W, and the second power Pr was set to 50 W. The timing of supply of the AC power P was set in accordance with one of three patterns such that the supply of the AC power P was started "simultaneously with the application of DC current," "after elapse of 1.0 ms from the application of DC current" or "after elapse of 2.0 ms from the application of DC current."

As shown in the upper section of FIG. 9, in the case where the supply of the AC power P was started "simultaneously with the application of DC current," the end of the AC power supply period Sa became earlier than the end of the DC power application period, and the misfire rate was 1.0 to 1.4%. As shown in the middle section of FIG. 9, in the ease where the supply of the AC power P was started "after elapse of 1.0 ms from the application of DC current," the end of the DC power application period overlapped with the second supply period Sa2 of the AC power supply period Sa, and the misfire rate was 0.1 to 0.9%. As shown in the lower section of FIG. 9, in the case where the supply of the AC power P was started "after elapse of 2.0 ms from the application of DC current," the end of the DC power application period overlapped with the first supply period Sa1 of the AC power supply period Sa, and the misfire rate was 0%.

According to the results of the evaluation test shown in FIG. 9, in order to improve the ignition performance, preferably, the end of the AC power supply period Sa is later than the end of the DC power application period. Further, more preferably, the end the DC power application period overlaps with the first supply period Sa1 of the AC power supply period Sa.

A-8. Effects

According to the above-described plasma ignition device 20, after AC plasma is generated in the AC power supply period Sa, the AC power P is reduced within the maintainable power range Rp, whereby the AC electric energy E can be reduced. Therefore, consumption of the electrodes by the AC plasma can be suppressed. As a result, the life of the spark plug 100 which generates AC plasma can be extended.

B. Other Embodiments

Although the embodiment of the present invention has been described, the present invention is not limited to the embodiment. Needless to say, the present invention can be implemented in various forms without departing from the scope of the present invention. For example, the pattern of reducing the AC power P is not limited to the pattern shown in FIG. 3, and the AC power P may be reduced in accordance with any of other patterns so long as the AC power P is reduced within the maintainable power range Rp after generation of AC plasma during the AC power supply period Sa.

Figure 10:
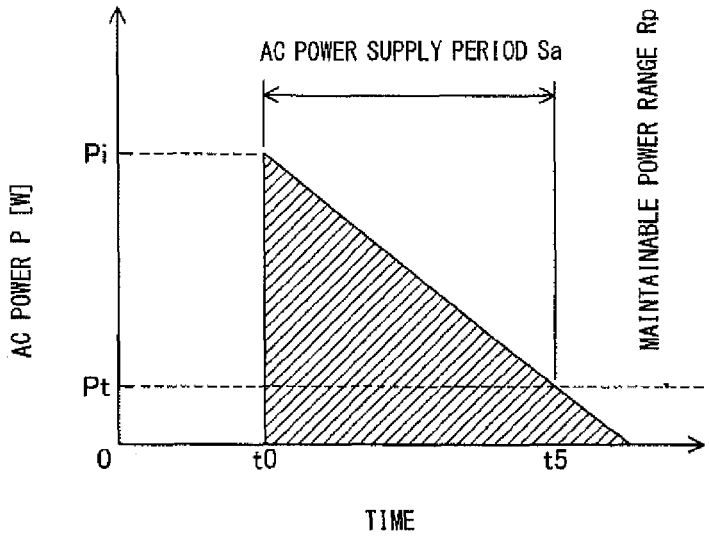
FIG. 10 is an explanatory graph showing a time-course change in AC power in a first modification.

FIG. 10 is an explanatory graph showing a time-course change of the AC power P in a first modification. In the first modification, the AC power P is set to the first power Pi at the start of the AC power supply period Sa (timing t0), and is continuously reduced from the first power Pi to 0 W such that, at the end of the AC power supply period Sa (timing t5), the AC power P becomes the minimum power Pt required to maintain AC plasma. According to the first modification as well, the consumption of the electrodes by AC plasma can be suppressed as in the case of the above-described embodiment.

Figure 11:
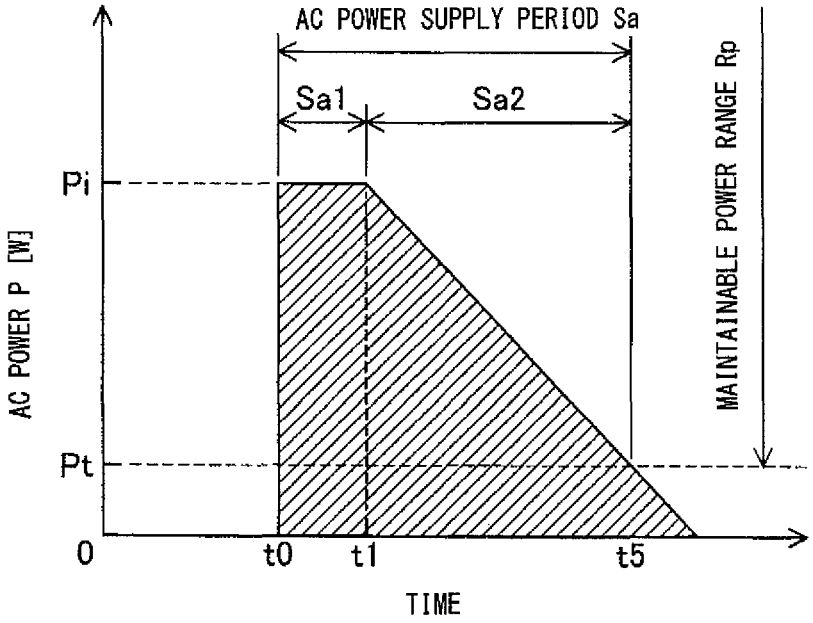
FIG. 11 is an explanatory graph showing a time-course change in AC power in a second modification.

FIG. 11 is an explanatory graph showing a time-course change of the AC power P in a second modification. In the second modification, the AC power P is maintained at the first power Pi during the first supply period Sa1. Subsequently, the AC power P is continuously reduced from the first power Pi to 0 W such that, at the end of the second supply period Sa2 (timing t5), the AC power P becomes the minimum power Pt required to maintain AC plasma. According to the second modification as well, the consumption of the electrodes by AC plasma can be suppressed as in the case of the above-described embodiment.

Figure 12:
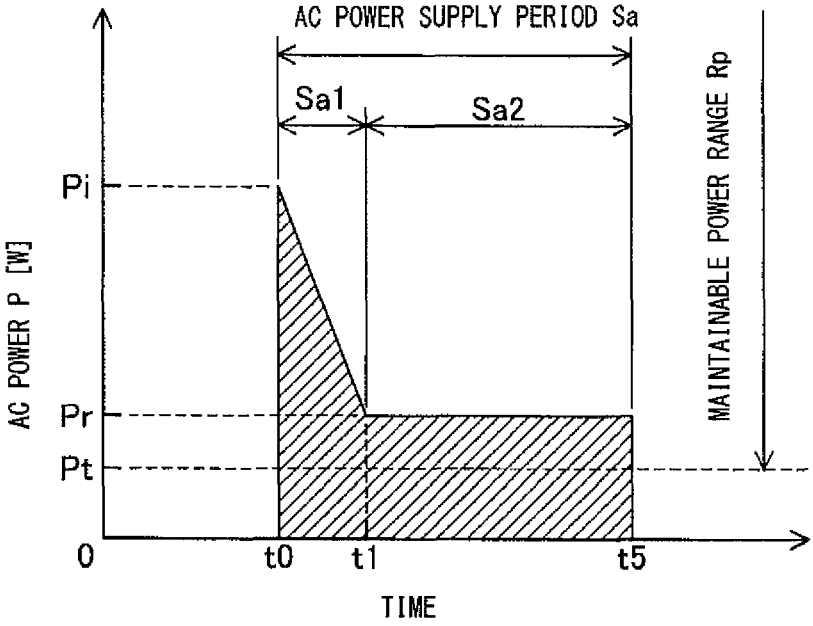
FIG. 12 is an explanatory graph showing a time-course change in AC power in a third modification.

FIG. 12 is an explanatory graph showing a time-course change of the AC power P in a third modification. In the third modification, the AC power P is set to the first power Pi at the start of the AC power supply period Sa (timing t0), and is continuously reduced from the first power Pi to the second power Pr such that, at the end of the first supply period Sa1 (timing t1), the AC power P becomes the second power Pr. Subsequently, the AC power P is maintained at the second power Pr during the second supply period Sa2. According to the third modification as well, the consumption of the electrodes by AC plasma can be suppressed as in the case of the above-described embodiment.

Figure 13:
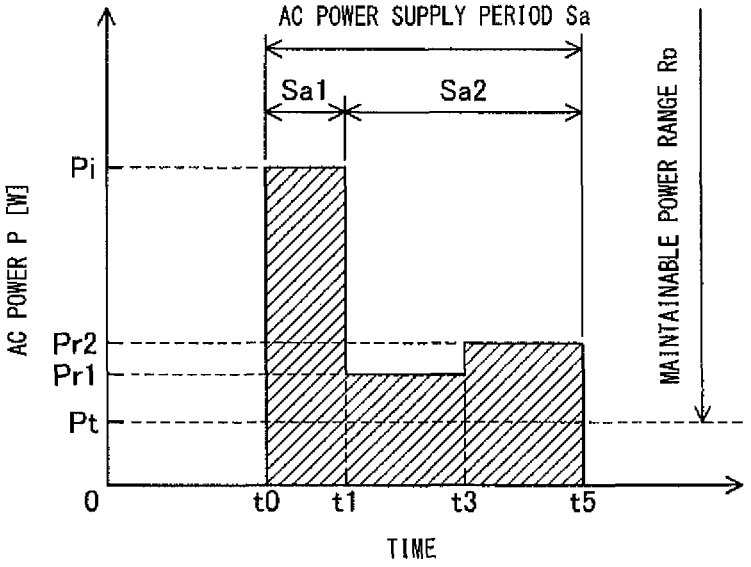
FIG. 13 is an explanatory graph showing a time-course change in AC power in a fourth modification.

FIG. 13 is an explanatory graph showing a time-course change of the AC power P in a fourth modification. In the fourth modification, the AC power P is maintained at the first power Pi during the first supply period Sa1. Subsequently, the AC power P is maintained at a power Pr1 during the first half of the second supply period Sa2 (timings t1 to t3). Subsequently, the AC power P is maintained at a power Pr2 during the second half of the second supply period Sa2 (timings t3 to t5). The power Pr1 and the power Pr2 are smaller than the first power Pi and fall within the maintainable range Rp, and the power Pr1 is smaller than the power Pr2. According to the fourth modification as well, the consumption of the electrodes by AC plasma can be suppressed as in the case of the above-described embodiment.

DESCRIPTION OF REFERENCE NUMERALS

10: operation control section
20: plasma ignition device
100: spark plug
110: center electrode
120: ground electrode
210: DC power supply
220: AC power supply
300: mixing section
310: inductor
320: capacitor
500: ignition control section
510: power control section
P: AC power
E: AC electric energy
Sa: AC power supply period
Sa1: first supply period
Sa2: second supply period
Rp: maintainable power range
Pi: first power
Pr: second power
Pr1: power
Pr2: power
Pt: power Having described the invention, the following is claimed:

1. A plasma ignition device comprising:
a spark plug;
an AC power supply which generates AC power for generating AC plasma between electrodes of the spark plug; and
a power control section for controlling the AC power generated by the AC power supply, wherein said power control section reduces the AC power during an AC power supply period, after AC plasma has been generated between the electrodes in the AC power supply period, wherein during the AC power supply period the AC power is continuously supplied to the spark plug within a maintainable power range within which the AC plasma can be maintained.

2. A plasma ignition device according to claim 1, wherein the power control section reduces the AC power in the AC power supply period at a timing which is after the AC plasma has been generated between the electrodes and is before elapse of a time corresponding to 75% of the AC power supply period.

3. A plasma ignition device according to claim 1, wherein the power control section reduces the AC power to a power which falls within the maintainable power range and is equal to or less than 80% of the AC power at the time of generation of the AC plasma.

4. A plasma ignition device according to claim 1, wherein the power control section reduces the AC power in the AC power supply period at a timing which is after the AC plasma has been generated between the electrodes and falls within a 1.0 msec period after the start of supply of the AC power.

5. A plasma ignition device according to claim 1, wherein the AC power supply period is 5.0 msec or less.

6. A plasma ignition device according to claim 1, wherein the electric energy supplied to the spark plug by the AC power during the AC power supply period of each cycle is 900 mJ or less.

7. A plasma ignition device according to claim 1, further comprising a DC power supply which generates DC power for generating spark discharge between the electrodes of the spark plug before generation of the AC plasma.

8. A plasma ignition device according to claim 7, wherein the end of the AC power supply period is after the end of a period during which the DC power is applied to the spark plug.

9. A plasma ignition device according to claim 7, wherein the power control section reduces the AC power within the period during which the DC power is applied to the spark plug.

10. A plasma ignition method for generating AC plasma between electrodes of a spark plug, the method comprising:
generating AC power using an AC power supply; and
reducing the AC power generated by the AC power supply during an AC power supply period, after having generated AC plasma between the electrodes in the AC power supply period, wherein during the AC power supply period the AC power generated by the AC power supply is continuously supplied to the spark plug within a maintainable power range within which the AC plasma can be maintained.

11. A plasma ignition method according to claim 10, wherein the AC power is reduced in the AC power supply period at a timing which is after the AC plasma has been generated between the electrodes and is before elapse of a time corresponding to 75% of the AC power supply period.

12. A plasma ignition method according to claim 10, wherein the AC power is reduced to a power which falls within the maintainable power range and is equal to or less than 80% of the AC power at the time of generation of the AC plasma.

13. A plasma ignition method according to claim 10, wherein the AC power is reduced in the AC power supply period at a timing which is after the AC plasma has been generated between the electrodes and falls within a 1.0 msec period after the start of supply of the AC power.

14. A plasma ignition method according to claim 10, wherein the AC power supply period is restricted to 5.0 msec or less.

15. A plasma ignition method according to claim 10, wherein the electric energy supplied to the spark plug by the AC power during the AC power supply period of each cycle is restricted to 900 mJ or less.

16. A plasma ignition method according to claim 10, wherein before generation of the AC plasma, spark discharge is generated between the electrodes of the spark plug using DC power generated by a DC power supply.

17. A plasma ignition method according to claim 16, wherein the AC power supply period is ended after the end of a period during which the DC power is applied to the spark plug.

18. A plasma ignition method according to claim 16, wherein the AC power is reduced within the period during which the DC power is applied to the spark plug.

* * * * *